US007523919B2

(12) United States Patent
Hanlon

(10) Patent No.: US 7,523,919 B2
(45) Date of Patent: Apr. 28, 2009

(54) CEILING MOUNTED LIFT

(76) Inventor: Mark Hanlon, 2839 Velasco La., Costa Mesa, CA (US) 92626

( * ) Notice: Subject to any disclaimer, the term of this patent is extended or adjusted under 35 U.S.C. 154(b) by 271 days.

(21) Appl. No.: 10/525,864

(22) PCT Filed: Dec. 26, 2002

(86) PCT No.: PCT/US02/41502

§ 371 (c)(1),
(2), (4) Date: Feb. 25, 2005

(87) PCT Pub. No.: WO2004/058624

PCT Pub. Date: Jul. 15, 2004

(65) Prior Publication Data

US 2006/0065807 A1 Mar. 30, 2006

(51) Int. Cl.
*B66D 1/26* (2006.01)

(52) U.S. Cl. ..... 254/278; 254/266; 248/324; 248/327; 248/329; 248/343

(58) Field of Classification Search ..... 254/266, 254/362; 248/324, 327, 329, 157, 330.1, 248/343, 49–74.5, 328, 332; 348/E5.143; 312/23; 52/31
See application file for complete search history.

(56) References Cited

U.S. PATENT DOCUMENTS 1,435,017 A * 11/1922 McCandless ..... 403/154
3,072,374 A * 1/1963 Bodian ..... 248/278.1
5,261,645 A * 11/1993 Huffman ..... 254/267
5,366,203 A * 11/1994 Huffman ..... 254/362
5,529,274 A * 6/1996 Anderson et al. ..... 248/329
5,551,658 A * 9/1996 Dittmer ..... 248/329
6,073,892 A 6/2000 Dittmer
6,161,702 A * 12/2000 Campbell ..... 211/17
6,286,794 B1 * 9/2001 Harbin ..... 248/123.2
6,305,556 B1 * 10/2001 Mayer ..... 211/26
6,345,799 B1 * 2/2002 Fusi ..... 248/320
6,484,993 B2 11/2002 Huffman
6,637,711 B2 * 10/2003 Enochs ..... 248/327
6,715,718 B1 * 4/2004 Chen et al. ..... 248/49
2002/0185637 A1 * 12/2002 Enochs ..... 254/266
2006/0065807 A1 * 3/2006 Hanlon ..... 248/327

OTHER PUBLICATIONS

Parallel. (2007). In The American Heritage® Dictionary of the English Language. Retrieved Jan. 24, 2008, from http://www.credoreference.com/entry.jsp?xrefid=7111501&secid=P0059700A-parallel. (2007). In The American Heritage® Dictionary of the English Language. Retrieved Jan. 24, 2008, from DISPLAYURL "parallel." The American Heritage® Diction.*

* cited by examiner

*Primary Examiner*—Emmanuel M Marcelo
(74) *Attorney, Agent, or Firm*—Fish & Associates, PC

(57) ABSTRACT

A ceiling mounted lift (200), of the type having a support frame (210) housing a drive mechanism (240) that operates to raise and lower a lifting platen (22) using a fabric drive roller (244), has a stabilizer (230), and is small enough to fit between standard ceiling joists. Preferred stabilizers have free movement in substantially only one plane and such arrangement is aided by the use of a bearing and hardened washers. Lifts according to the present invention can safely have a travel distance of up to 50 feet, and can manage payloads up to 1000 pounds.

22 Claims, 4 Drawing Sheets

CEILING MOUNTED LIFT

FIELD OF THE INVENTION

The field of the invention is ceiling mounted lifts.

BACKGROUND OF THE INVENTION

A home theatre incorporates into a home components traditionally used in a theatre to enhance the experience of watching movies and other shows. While use of such components generally results in a larger viewing area and better sound, the components are considered obtrusive in a house because of their size and appearance.

With regard to size, large projectors, speakers, and screens take up floor and wall space. With regard to appearance, the components detract from the overall aesthetic appearance of the home. For example, a Sony® Cineza LCD front projector utilizes an LCD projector that is mounted on a stand in front of the viewing screen. The screen, the projector and stand all take up considerable floor space. In order to solve some of these problems, projectors and even speakers are sometimes raised above ground level often by hanging them from a ceiling. While mounting to a ceiling definitely releases floor space, the aesthetic impact is somewhat less helpful, because there is still a relatively large device hanging from the ceiling.

U.S. Pat. No. 5,551,658 to Dittmer (September 1996) teaches a ceiling mounted projector lift system that moves a projector between a raised operating position and a lowered maintenance position. Dittmer describes use of a motorized wench assembly and cables to raise and lower the projector. While the '658 patent may have some advantages over other lift systems, the lift remains substantially below the ceiling surface in both the operational and non-operational positions, and therefore is still aesthetically undesirable. U.S. Pat. No. 6,073,892 also to Dittmer (June 2000) addresses the non-operational footprint of a lift. Contrary to the '658 patent, the '892 patent teaches a lift in which the raised position is the non-operational position and the lowered position is the operational position. Dittmer describes use of a slide bracket or telescoping structure to move a projection device between the non-operational position and the operational position. Dittner's device may have reduced the non-operational footprint of a lift, but problems remain. One particular problem is the stability of telescoping arms both during raising and lowering of the component and also during operation. A persisting problem is the aesthetic appearance of the lift, which even while in a non-operational position, remains below the ceiling surface.

U.S. Pat. No. 6,484,993 to Huffman (November 2002) addresses at least some of the problems related to aesthetic appearance while in the non-operational position. Huffman teaches a lifting device mounted within a ceiling plenum. The non-operational position of the display is such that the viewing surface is substantially parallel to the floor. In preparation for viewing, the device operates to swing the display down 90 degrees or until the viewing surface is perpendicular to the floor. There are, however, problems with the design taught by Huffman, though. Huffman relies upon a sufficient plenum area above the ceiling surface. It appears that only a relatively flat display will fit in the plenum. Moreover, if the surface of the ceiling is joined directly to the ceiling joists, there is insufficient area to conceal the device.

Thus, there remains a need for ceiling mounted lifts that are more stable and less obtrusive.

SUMMARY OF THE INVENTION

The inventive subject matter is a ceiling mounted lift which is sized and dimensioned to stow substantially above a ceiling surface. In one aspect, a stabilizer is coupled by a first arm to a support frame and by a second arm to a lifting platen that typically supports an electrical component. In a further aspect, the stabilizer includes a bearing and hardened washers such that movement of the stabilizer is substantially planar. Yet a further aspect includes a double fabric drive roller that utilizes a tubular motor.

Various objects, features, aspects and advantages of the present invention will become more apparent from the following detailed description of preferred embodiments of the invention, along with the accompanying drawings in which like numerals represent like components.

DETAILED DESCRIPTION

Figure 1:
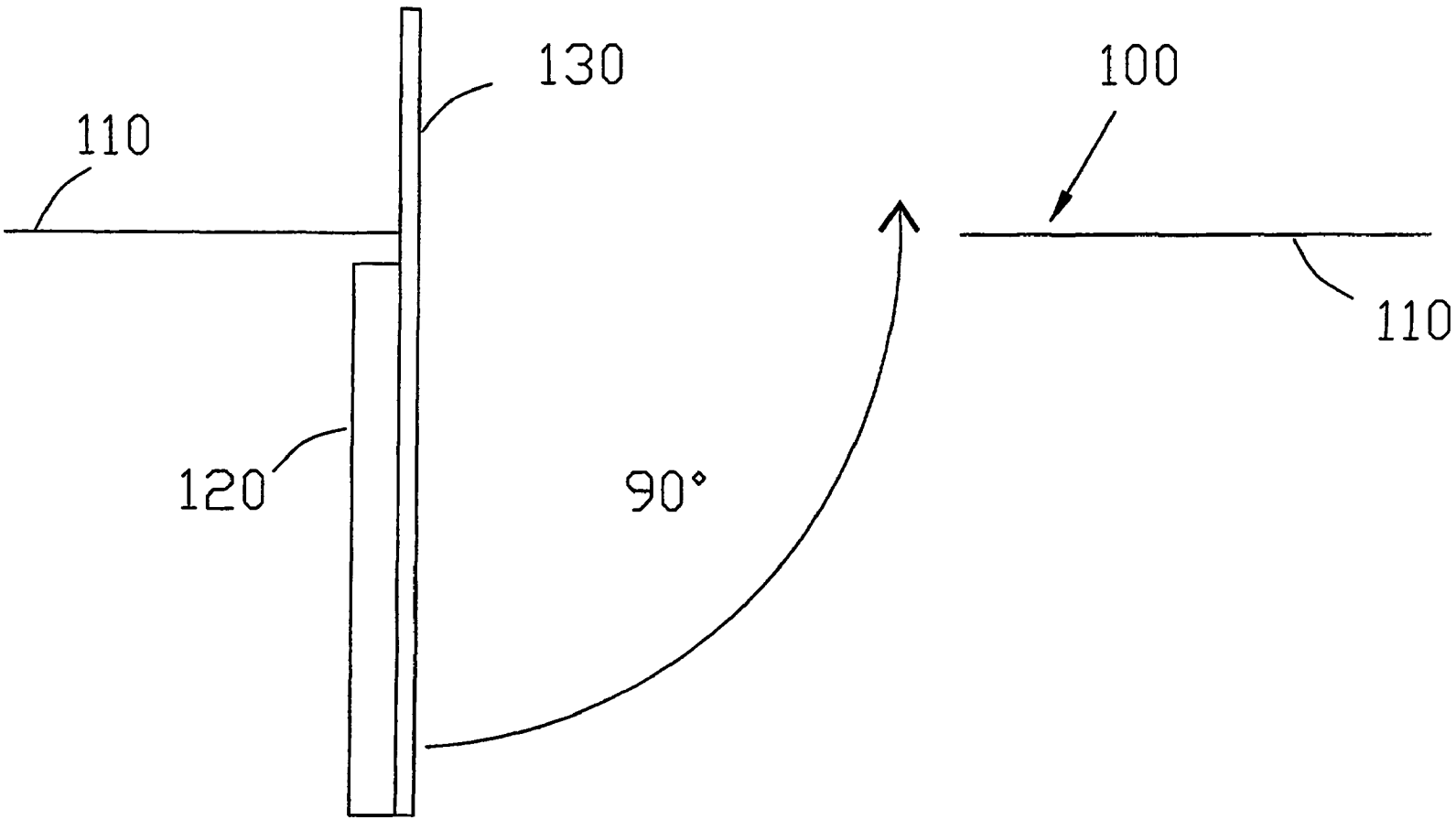
Fig. 1 (Prior Art)
FIG. 1 is a cross-sectional view of a prior art lift.

Referring first to FIG. 1*a*, a prior art lift 100 comprises a viewing display 120 that generally is stored above a ceiling surface 110. The display 120 swings approximately 90° from a non-operational position in which the display is parallel to the ceiling surface to an operational position in which the viewing display 120 is perpendicular to the ceiling surface. In order for the viewing display 120 to be stowed above the ceiling surface, there must be sufficient distance between the bottom of the ceiling joists (not shown) and the ceiling surface 110. Prior art lift 100 does not contain any stabilizer.

Figure 2:
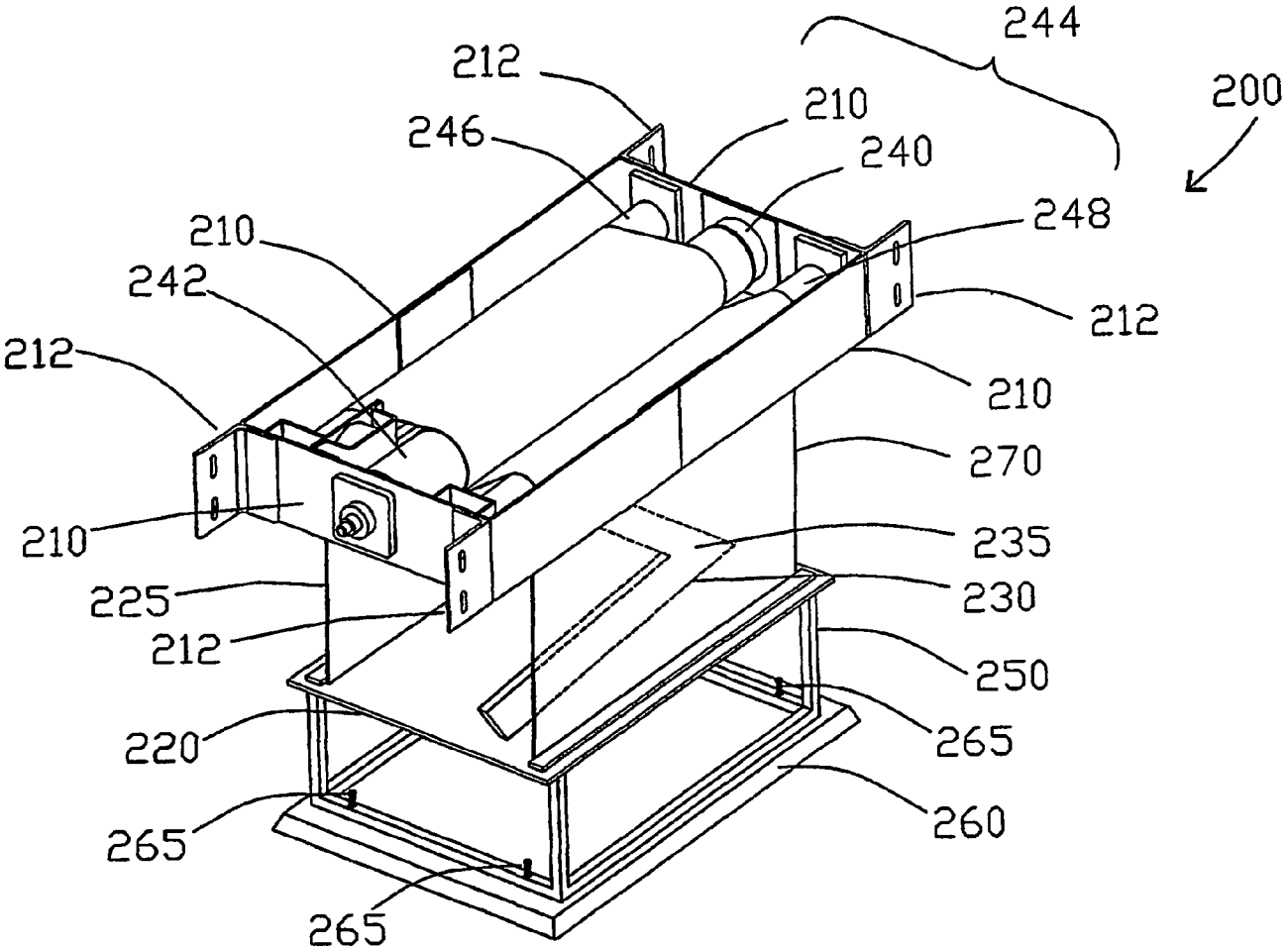
FIG. 2 is a perspective view of a ceiling mounted lift.

In FIG. 2, a ceiling mounted lift 200 according to the inventive subject matter generally comprises a support frame 210, a lifting platen 220, a stabilizer 230, a drive mechanism 240, a component housing 250, and a ceiling panel 260.

The support frame 210 is generally comprised of a light weight material such as aluminum, but any appropriate material will suffice including other metals, thermoplastics (e.g. polyethylene), woods, composites, and so forth. A frame, including a projector or other component mounted directly or indirectly to the frame, can be mounted to a plurality of ceiling joists by mounting brackets 212 and screws, bolts, or other connectors (not shown). The structure of a support frame, although depicted as a combination of multiple pieces coupled together, can be comprised of a single piece, so long as the frame satisfies the functions described herein.

A preferred support frame has some means for attachment to a ceiling joist, which thereby provides support for the drive mechanism 240, drive tube 242 and idler tubes 246 and 248. It is also advantageous that a frame be designed to fit within a typical ceiling structure, which in the United States has joists that run 16 inches on center (i.e. about 14.5 inches between them for standard 2×10s). In other countries the standard joist spacing would be different from that in the U.S., however a frame and all that is housed within the frame should be sized to fit within a space between joists (e.g. 14.5 inches). The frame 210 depicted in FIG. 2, is no more than 12.5 inches at its shorter side (assuming a rectangular shaped frame) and therefore, it can easily fit within the 14.5 inch spread between the ceiling joists. In embodiments in which the lift is less than 14.5 inches at its shorter side, some degree of adjustment space will be achieved. The amount of adjustment space can be calculated as the difference between the space between joists and the length of the shorter side of the frame. Using 14.5 as the distance between joists and 12.5 as the length of the shorter side of the fame, a 2 inch wiggle room can be achieved. Of course, the longer side of the frame should be sufficiently short to enable mounting into a standard ceiling without interfering with cross-sectional members. It is contemplated that the entire lift including the support frame will be no longer than 23.25 inches at its longest length, although reasonable variants should apply with all numbers.

In a preferred class of embodiments, a double fabric drive assembly is utilized to raise and lower a portion of the lift. A double fabric drive assembly 244 generally consists of a drive tube 242, two idler tubes 248 and 248, a first fabric panel 270, and a second fabric panel 275. FIG. 2 depicts a double fabric drive assembly 244 wherein a tubular drive mechanism 240 is enclosed essentially within the drive tube 242 (i.e. the middle tube) and the drive mechanism 240 operates to raise and lower the lifting platen 220 using first fabric panel 270 and second fabric panel 275. For the drive mechanism, a Somfy® Systems 40 series motor is contemplated and for the fabric panels, vinyl impregnated woven nylon mesh is contemplated. It should be appreciated, however, that other appropriately powered motors and fabric panel materials can be used.

Lifting platen 220 is preferably an aluminum plate attached to the component housing 250 that will generally house a home theatre component (e.g. a projector, speaker(s)). In some aspects, a lifting platen 220 forms a portion of the component housing, and in fact, the fabric panels can be attached directly to the home theatre component in which case, the lifting platen is a surface of the finished good home theatre component. In any case, a lifting platen should be capable of receiving an arm of the scissor stabilizer, and therefore the lifting platen contributes, at least in part, to stabilizing the lift.

With regard to the ceiling panel 260, it is contemplated that by attaching a ceiling panel to the component housing 250, the lift 200 will be substantially concealed from view when it is in its raised non-operational position. Thus, a ceiling can be comprised of dry wall or other material used for ceilings. A ceiling panel 260 can be held to the lift 200 by one or more spring loaded bolts 265. While spring loaded bolts are not required, they are preferred in order to give the ceiling a substantially contiguous look when the lift is in a non-operational position. Because there is a degree of error in the lift, the spring loaded bolts can be used to ensure that the ceiling panel 260 looks level with the surrounding ceiling.

The utility of a lift is not limited to home theatre, and in fact, a lift can have application in offices, auditoriums, stadiums, airports, and other places where there is a need to raise and lower something. While a preferred lift typically moves only a few feet between its raised position and its lowered position the subject matter should not be restricted in this manner as lifts are modular and scalable. Preferred lift distances are at least 5 feet, at least 10 feet, at least 25 feet, and at least 50 feet. Preferred maximum payloads are 25 pounds, 50 pounds, 100 pounds, 250 pounds, 500 pounds, and 1000 lbs.

While a preferred lift supports an item that is non-operational in the raised position and operational in a lowered position, the opposite may be true. An item can be operational in a raised position and non-operational in a lowered position. Consider a lift that lowers an item for maintenance (e.g. a message board, light fixture or object of art). An expanded concept includes a lift that is used to lower a person to do maintenance as for example on a bridge, dam, or office building. Thus, it should be appreciated that there are varied uses of the lifts described herein.

Figure 3:
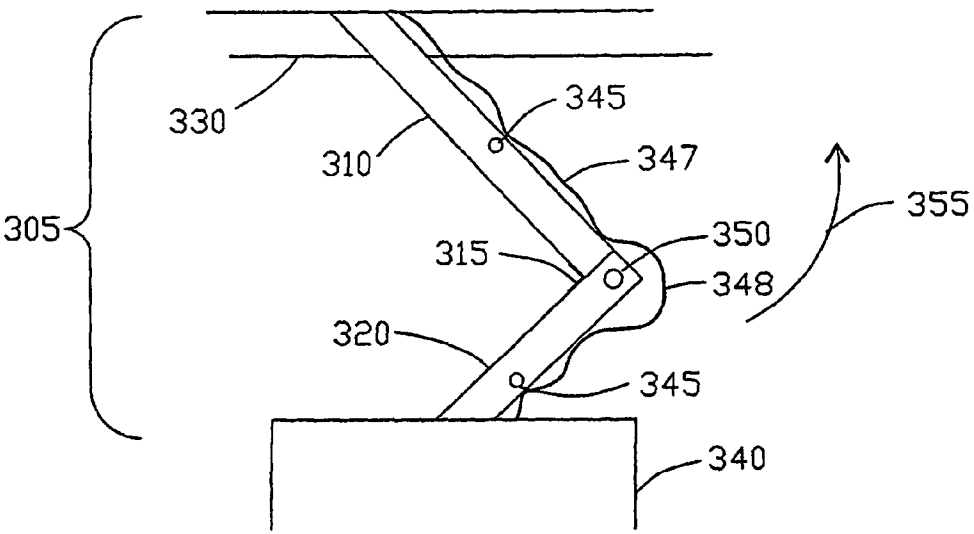
FIG. 3 is a cross sectional view of a scissor stabilizer.

Focusing on FIG. 3, a stabilizing system 300 is generally comprised of a stabilizer assembly 305 having a first arm 310 and a second arm 320. The first arm 310 is coupled to frame 330 and to lifting platen 340.

Stabilizer assembly 305 is generally "V" shaped and its operational movement is similar to a scissor. The arms 310 and 320 of the stabilizer assembly 305 can be constructed out of any appropriate material or combination of materials including metals (tube steel, aluminum) and thermoplastics. The arms of a preferred stabilizer have a dimension of about 3/16×1 inch while the length of the arms can vary based on the length of the rise/drop of the lift.

In some aspects, especially where the length of the rise/drop is large (i.e. over 10 feet), a torsion bar spring 315 is used at the joint to bias the arms toward each other. The spring loaded joint helps to stabilize the lift, especially in the raised position. Many types of springs are appropriate including a torsion bar, coil spring, precision spring, and so on. Additional and alternative aspects include use of multiple stabilizers, sometimes coupled to each other.

Figure 3A:
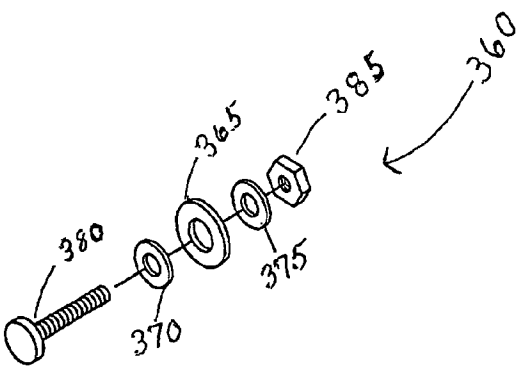
FIG. 3*a* is a perspective view of a pin joint.

Each arm has a hole (bore) through it and the holes are used to couple the arms together at a pivot 350. In preferred embodiments, the arms are coupled together using a pinned joint 360 depicted by FIG. 3*a* at the pivot 350. The pinned joint 360 is comprised of a bearing 365 (e.g. thrust bearing), two hardened washers 370 and 375 a pin 380 and a bolt 385. The joint 360 permits substantially unrestricted planar movement about the axis of the connection point. The use of hardened washers 370 and 375 further restricts movement in any plane that is not substantially parallel to the plane of free movement. Stability of the device is therefore enhanced by restricting movement to a single plane.

Wires 347 carrying signals and power can run from the ceiling area to a device being raised or lowered. Because these wires can be damaged during movement of the stabilizer assembly 305, it can be advantageous to have holes 345 in the arms 310 and 320 of the stabilizer assembly 305 secure the wires 347 from damage. Moreover, a service loop 348 can be used to further avoid damage at the pivot 350.

As the lifting platen is raised, the distance between the lifting platen 340 and the frame 330 is reduced. Such movement causes the arms of the stabilizer to rotate about the pivot 350 and causes the pivot 350 to travel upwards along a curved path 355. The curved path of the pivot 350 remains substantially planar as the pivot travels.

Figure 4:
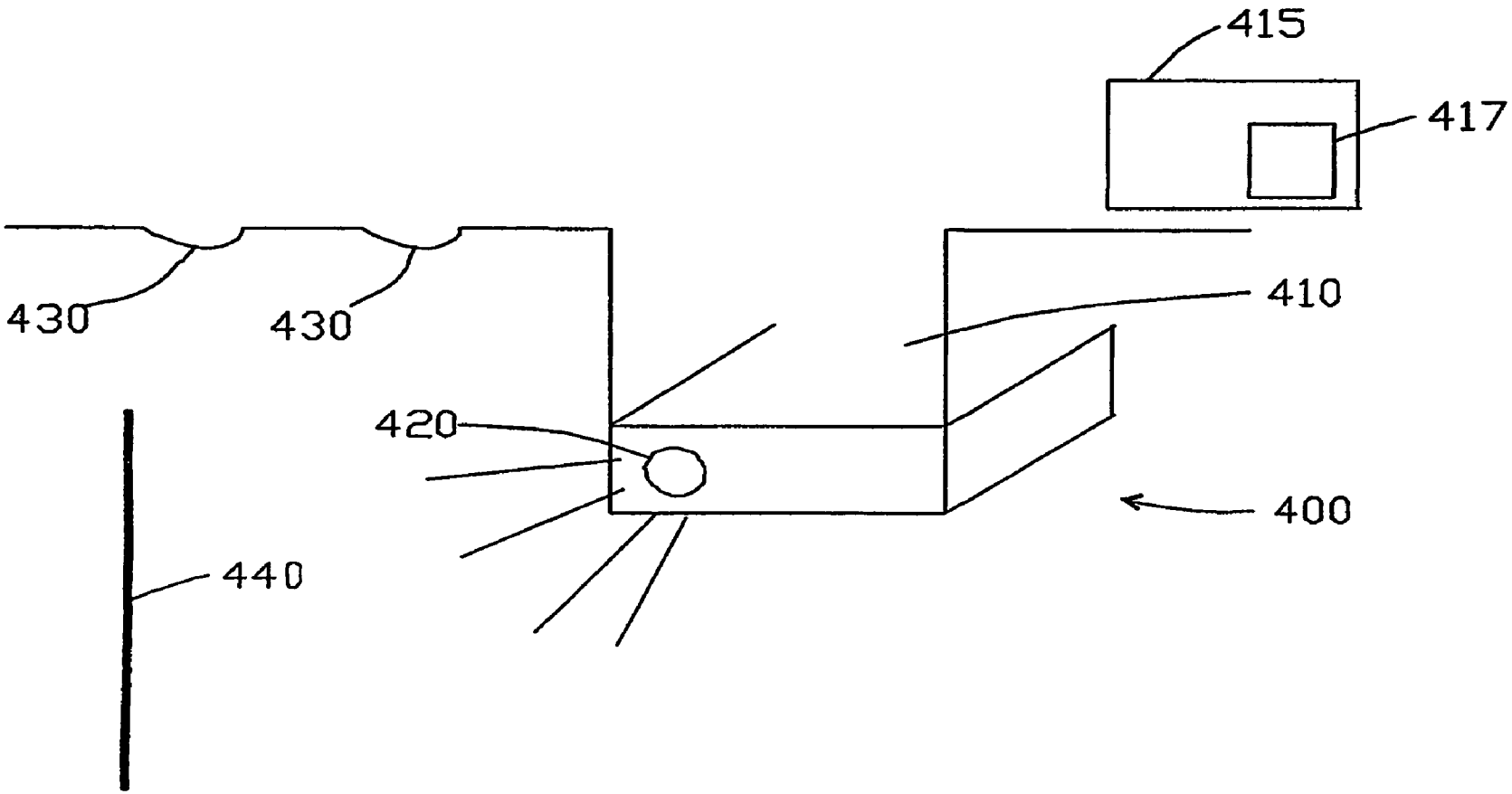
FIG. 4 is a perspective view of a home theatre system.

In FIG. 4, a home theatre system 400 includes a lift 410 supporting a projector 420, speakers 430, and a display screen 440. The lift is in communication with a drive controller 415 having a wireless transceiver 417. The drive controller 415 can be used to control and/or provide power to the drive mechanism (not shown) of the lift 410. A preferred drive controller has a wireless transceiver or receiver in order to receive signals from a remote control device. It is further contemplated that a lift can be incorporated into a home appliance center and control of the lift can therefore be accomplished using a computer or other device programmed to control home appliances. Such control can also be accomplished remotely from a distal location, if necessary. It may be desirable for a parent to monitor a child's "T.V. time", and as such, enhancements can be built into the controller that can prevent the lift and or the projector from operation without authority.

Methods of stabilizing a ceiling mounted lift include the step of prohibiting movement in all but one plane. In some aspects prohibiting movement further includes the step of coupling the arms of the stabilizer using hardened washer on opposing sides of a bearing. Other methods include concealing a lift substantially above a ceiling surface by sizing the lift to fit within a standard ceiling joist configuration. Additional concealing steps can include coupling a ceiling panel to the lift using spring loaded bolts or other connectors.

Thus, specific embodiments and applications of a ceiling mounted lift have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A ceiling mounted lift, comprising:

a support frame housing a double fabric panel drive assembly with first and second panels disposed on separate rollers, the panels cooperating to raise and lower a lifting platen;

wherein a flat surface of the first panel and a flat surface of the second panel each define substantially parallel planes that are not co-planar when the lifting platen is lowered; and a stabilizer having a first arm and a second arm, such stabilizer disposed between the support frame and the lifting platen, and disposed between the first and second panels such that operational motion of the stabilizer is in a plane that is substantially parallel to the planes defined by the flat surfaces of the first and second panels when the lifting platen is raised or lowered, to prohibit motion in all but one plane.

2. The ceiling mounted lift of claim 1, wherein the stabilizer comprises a bearing at a pivot joining the first and second arms.

3. The ceiling mounted lift of claim 2, further comprising a first hardened washer on a side of the bearing and a second hardened washer on an opposing side of the bearing.

4. The ceiling mounted lift of claim 3, wherein all movement of the stabilizer is substantially planar.

5. The ceiling mounted lift of claim 1, further comprising a hole in the stabilizer and a tie wrap.

6. The ceiling mounted lift of claim 1, wherein the drive mechanism comprises a double fabric drive roller.

7. The ceiling mounted lift of claim 1, further comprising a wireless transceiver that cooperates with a controller to operate the drive mechanism.

8. A home appliance center including the lift of claim 7.

9. The ceiling mounted lift of claim 1, further comprising a home theatre component.

10. The ceiling mounted lift of claim 9, wherein the home theatre component is at least one of a projector and a plasma screen.

11. The ceiling mounted lift of claim 1, further comprising a device lowered for maintenance.

12. The ceiling mounted lift of claim 11, wherein the device lowered for maintenance is at least one of a light fixture and a message board.

13. A home theatre system comprising the lift of claim 1.

14. A ceiling mounted lift, comprising:

a support frame having a length and a width;

the frame housing a double fabric panel drive assembly with first and second panels each having first and second opposing faces oriented parallel to the length of the support frame, but disposed in different planes, the panels cooperating to raise and/or lower a lifting platen to prohibit motion in all but one plane;

using a fabric drive roller; and the support frame housing sized and dimensioned to stow substantially above a ceiling surface.

15. The ceiling mounted lift to claim 14 having a side by side dimension such that the lift can be mounted between ceiling joists spaced 16 inches on center.

16. An installed ceiling mounted lift comprising the lift of claim 14 having a side by side dimension that is at least 2 inches less than a space between the ceiling joists.

17. An installed ceiling mounted lift, comprising;

a support frame housing a drive mechanism that operates to raise and lower a lifting platen using different first and second fabric rollers having first and second fabric panels, respectively, each of the panels having parallel but non-coplanar, flat surfaces sufficiently wide to prohibit motion in all but one plane; and a ceiling panel held to the lift by a spring loaded bolt.

18. The lift of claim 17 having a lift distance of at least 50 feet.

19. The lift of claim 17 having a maximum payloads of at least 250 pounds.

20. An improved ceiling mounted lift having a horizontal cross-section having a length and a width, and a double fabric panel drive assembly that supports a lifting platen, wherein the improvement comprises;

the lift is sized and dimensioned to stow substantially above a ceiling surface and between joists spaced 16 inches on center; and the panel drive assembly includes first and second panels with parallel but non-coplanar, flat surfaces to prohibit motion of the lifting platen in all but one plane.

21. A ceiling mounted lift having;

a double fabric panel drive assembly, with a first panel having a width that defines a first plane and a flat surface across its width, and a second panel having a width that defines a second plane and a flat surface across its width, the first and second planes being parallel but not co-planar;

a stabilizer disposed in a third different plane; and the width of the panels and orientation of the planes sufficient to prevent motion in all but one plane.

22. The lift of claim 21 wherein the first and second panels are coupled to a lifting platen, and are sufficiently wide to provide significant horizontal stabilization to the platen.

* * * * *